US008672816B2

(12) United States Patent
Lien

(10) Patent No.: US 8,672,816 B2
(45) Date of Patent: Mar. 18, 2014

(54) DUMBBELLS AND BARBELLS WITH IMPROVED ATTACHMENTS

(75) Inventor: Louis Lien, Bellaire, TX (US)

(73) Assignee: USA Sports, Inc., Houston, TX (US)

( * ) Notice: Subject to any disclaimer, the term of this patent is extended or adjusted under 35 U.S.C. 154(b) by 191 days.

(21) Appl. No.: 13/460,317

(22) Filed: Apr. 30, 2012

(65) Prior Publication Data

US 2013/0288862 A1 Oct. 31, 2013

(51) Int. Cl.

| | |
|---|---|
| ***A63B 21/072*** | (2006.01) |
| ***A63B 21/075*** | (2006.01) |
| ***B23P 11/00*** | (2006.01) |
| ***B23P 17/00*** | (2006.01) |

(52) U.S. Cl.
USPC ..... 482/108; 482/106; 482/107; 29/525.14

(58) Field of Classification Search
USPC ..... 482/92, 93, 106–108; 29/592, 248, 29/525.01, 525.11, 525.13, 525.14
See application file for complete search history.

(56) References Cited

U.S. PATENT DOCUMENTS

| | | | | |
|---|---|---|---|---|
| 5,464,379 | A * | 11/1995 | Zarecky | 482/108 |
| 6,099,443 | A * | 8/2000 | Landfair | 482/108 |
| 6,602,169 | B1 * | 8/2003 | Patti | 482/107 |
| 7,491,156 | B1 * | 2/2009 | GaoYong | 482/108 |
| 7,740,569 | B2 * | 6/2010 | Patti | 482/107 |
| 2003/0232705 | A1 * | 12/2003 | Harms et al. | 482/108 |
| 2006/0073950 | A1 * | 4/2006 | Lincir | 482/108 |
| 2007/0287611 | A1 * | 12/2007 | Januszek | 482/107 |
| 2008/0220952 | A1 * | 9/2008 | Yang | 482/107 |
| 2010/0075816 | A1 * | 3/2010 | Anderson | 482/107 |
| 2012/0172182 | A1 * | 7/2012 | Leier et al. | 482/108 |

* cited by examiner

*Primary Examiner* — Oren Ginsberg
*Assistant Examiner* — Garrett Atkinson
(74) *Attorney, Agent, or Firm* — Osha Liang LLP

(57) ABSTRACT

A weight lifting system includes a handle bar and two weight plates. The handle bar is made of a first material and is attached to the two weight plates by inserting each of two ends of the handle bar in a hole in each of the two weight plates, wherein at least one of the two weight plates comprises a center portion made of a second material and a peripheral portion made of a third material, wherein the third material is different from both the first material and the second material, wherein the center portion comprises the hole, in which one of the two ends of the handle bar is inserted, and the center portion is welded to the handle bar.

10 Claims, 5 Drawing Sheets

FIG. 1
(Prior Art)
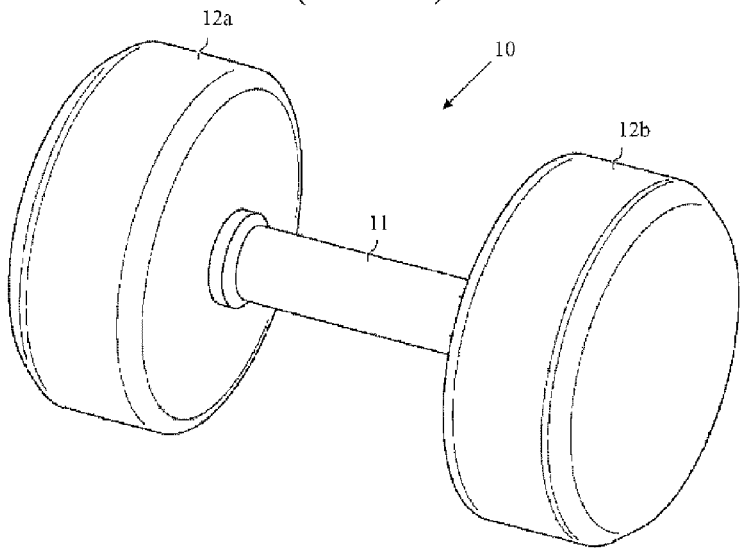
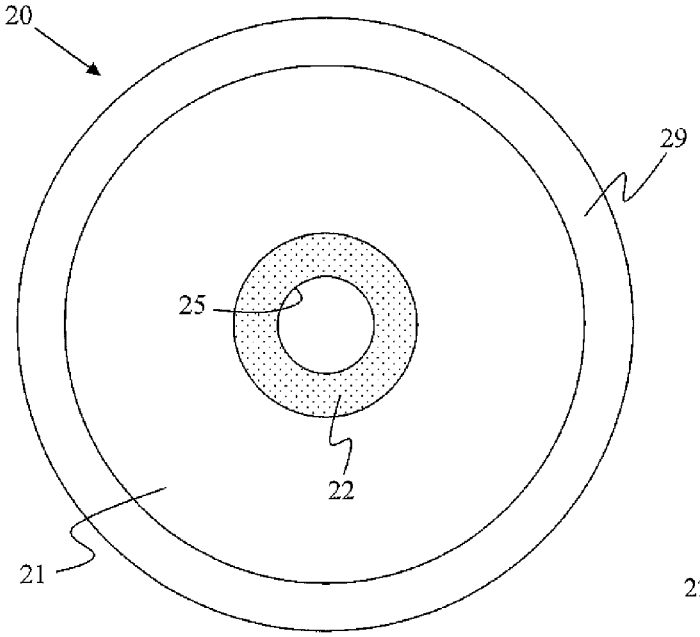
FIG. 2A
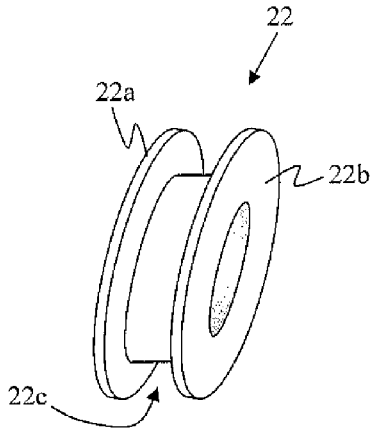
FIG. 2B

DUMBBELLS AND BARBELLS WITH IMPROVED ATTACHMENTS

BACKGROUND OF INVENTION

1. Field of the Invention

The invention relates generally to exercise equipment. Specifically, this invention relates to dumbbells and barbells, and methods for making same.

2. Background Art

Dumbbells and barbells have been used for building body strength and for general fitness, strength and endurance training, and physical rehabilitation. Typically, dumbbells and barbells have elongated cylindrical bars or handles with disk-shaped weight heads (or weight plates) placed at both ends.

FIG. 1 shows a schematic illustrating a typical dumbbell 10, which comprises a handle 11 and two weight plates 12*a* and 12*b*. The handles 11 and/or weight plates 12*a* and 12*b* may be coated with a resilient material, such as vinyl, urethane, or rubber, to prevent marring of floors and other surfaces. Such coatings also help alleviate the noise that otherwise would result from the banging of the dumbbells or barbells against other equipment.

Dumbbells and barbells are often used in a rough manner and are commonly dropped on the floor or banged against other equipment. Durability and safety are therefore essential requirements for dumbbells and barbells, particularly for devices used in commercial settings, where heavy use is expected. Therefore, the bars or handles 10 are typically made of strong and durable materials, such as carbon steel, stainless steel, cast iron, and the like, and the weight plates 12*a* and 12*b* are typically made of durable and heavy materials, such as steel, cast iron, concrete, and others. Among these materials, steel and cast iron are among the most frequently used because they are strong and durable.

Dumbbells and barbells may be categorized as fixed-weight or adjustable-weight dumbbells or barbells. Fixed-weight dumbbells and barbells have weight plates that are permanently or semi-permanently fixed—i.e., the weight plates in fixed-weight dumbbells or barbells are not intended to be changed by users. On the other hand, in adjustable dumbbells and barbells, weight plates are attached in a removable manner and may be added and removed by the users as needed.

For fixed-weight dumbbells or barbells, the attachment of weight plates to handle bars may be accomplished by bolts and nuts or by welding. The use bolts or nuts has a number of drawbacks because dumbbells and barbells often endure multiple types of mechanical stresses, shocks, and vibrations during the course of a workout as they are haphazardly dropped and tossed about. These mechanical stresses, shocks, and vibrations can cause the bolts holding the weight plates on the bar or handle to gradually work themselves loose over time and back out, rendering the dumbbells or barbells potentially unsafe. Therefore, permanent attachments by welding the weight plates to the handle bars is often preferred.

Permanently attached dumbbells or barbells are typically made of cast iron or steel, and in some cases the entire handle and weighted plates may be formed of a single piece of material, such as steel. Although dumbbells and barbells made entirely of steel may be desirable, they are far more expensive, as compared to those made of cast iron. On the other hand, cast iron is more brittle than steel, and it is undesirable to make the dumbbells or barbells entirely out of cast iron. Therefore, combinations of steel bars and cast iron weight plates seem to present a good compromise that takes advantage of different material properties and reduced costs.

Although steel and cast iron may be welded together, the steel and cast iron welds may be brittle and weak due to the different properties of cast iron and steel, such as different melting temperatures, different hardness, and different thermal expansion coefficients. Therefore, there remains a need for improved methods for making dumbbells and barbells that remain secure and safe.

SUMMARY OF INVENTION

One aspect of the invention relates to weight lifting systems. A weight lifting system in accordance with one embodiment of the invention includes a handle bar and two weight plates. The handle bar is made of a first material and is attached to the two weight plates by inserting each of two ends of the handle bar in a hole in each of the two weight plates, wherein at least one of the two weight plates comprises a center portion made of a second material and a peripheral portion made of a third material, wherein the third material is different from both the first material and the second material, wherein the center portion comprises the hole, in which one of the two ends of the handle bar is inserted, and the center portion is welded to the handle bar. The first and second materials may be steel and the third material may be cast iron.

A weight lifting system may further comprises a nut threaded on an end of the handle bar. The nut may be further welded to the handle bar. The handle bar and/or the weight plates may be further encased in a protective coating.

Another aspect of the invention relates to methods for manufacturing weight lifting systems. A method in accordance with one embodiment of the invention includes inserting an end of a handle bar made of a first material in a hole in a weight plate, wherein the weight plate comprises a center portion made of a second material and a peripheral portion made of a third material, the third material is different from both the first material and the second material, and wherein the hole in the weight plate is located in the center portion; and welding together the handle bar and the center portion of the weight plate.

A method may further includes threading a nut to an end of the handle bar. The method may further comprising welding the nut to the handle bar. The method may further comprise encasing the handle bar and/or the weight plate in a protective coating.

Other aspects and advantages of the invention will be apparent from the following description and the appended claims.

BRIEF DESCRIPTION OF DRAWINGS

FIG. 1 shows a prior art dumbbell.

FIG. 2A shows a weight plate in accordance with one embodiment of the invention.

FIG. 2B shows one center portion of a weight plate in accordance with one embodiment of the invention.

DETAILED DESCRIPTION

Figure 3:
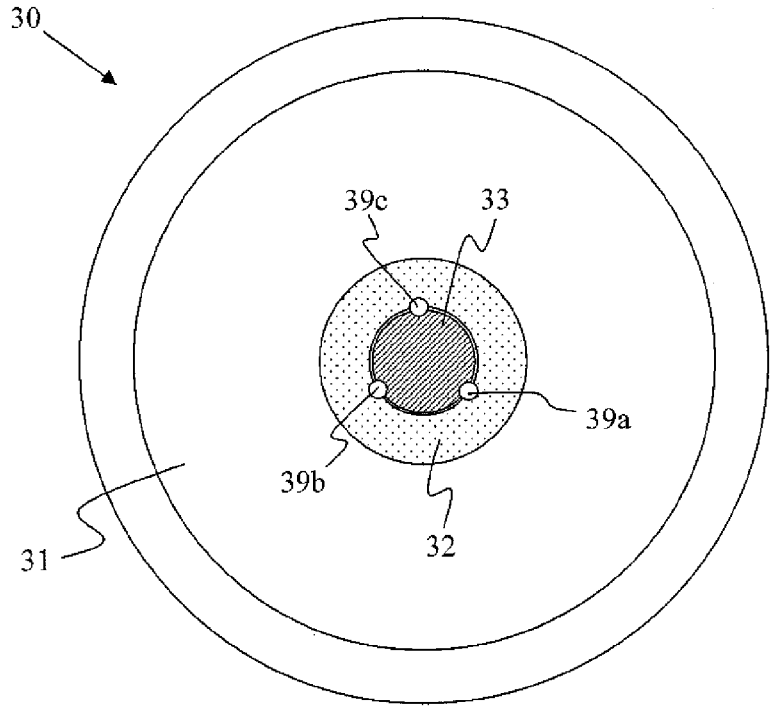
FIG. 3 shows a weight plate inserted on one end of a handle bar in accordance with one embodiment of the invention.

Embodiments of the invention relate to weight lifting systems and methods for manufacturing the weight lifting systems. A "weight lifting system" as used herein refers to a dumbbell or a barbell, particularly a fixed-weight dumbbell or barbell. For clarity, the following description will use dumbbells as examples to illustrate embodiments of the invention. However, one skilled in the art would appreciate that this description is equally applicable to barbells.

As noted above, fixed-weight dumbbells typically have handle bars made of steels because steel has better design flexibility, corrosion resistance, and weldability. Although dumbbells entirely made of steel may be easily manufactured by welding steel handles with steel weight plates, steel is far more expensive than cast iron. Therefore, a better choice is to use steel handle bars with cast iron weight plates. However, as noted above, welding steel with cast iron is problematic because they have different properties—e.g., cast iron is brittle (having low ductibility) and has a lower melting temperature than that of steel. Embodiments of the invention provide a new approach to overcoming such welding problems.

Specifically, methods of the invention allow one to use two different materials for the handle bars and the weight plates of dumbbells, respectively, without problems associated with weak weld joints. That is, in accordance with embodiments of the invention, a handle bar of a weight lifting system may be made of a first material (e.g., steel), while the weight plates may be mainly made of a material (e.g., cast iron) that is different from the first material in the handle bar. Embodiments of the invention may include any combination of different materials, such as steel handle bars and cast iron weight plates, or steel handle bars and weight plates made of other heavy metals, etc. However, for clarity of illustration, the following description will use dumbbells having steel handle bars and cast iron weight plates as examples. One skilled in the art would appreciate that these methods are also applicable with other combinations of materials.

Cast iron is hard, dense (heavy), wear-resistant, and relatively inexpensive, making it a good choice for making weight plates. Cast iron is an iron-carbon alloy, which may also contain silicon and other elements. Cast irons typically contain more carbon (typically >2% carbon), as compared to steel (which typically contains <2% carbon). The relatively high contents of carbon in cast irons result in cast irons having properties that are very different from those of steels. In a finished steel, carbon combines with iron to form iron carbides. However, in cast irons, most carbon is present as graphite.

Different grades of cast irons result from different forms of graphite in the finished iron. Gray iron is the most common type used in various applications, including dumbbells. While the following discussion is based on gray cast iron, this may be similarly apply to other grades of cast irons. Gray cast iron is characterized by the grayish color at its fractured surface. The graphite in gray iron is mostly in the form of flakes, rendering gray irons easily machinable. However, the flake form of graphite also makes gray cast iron relatively brittle (having little ductility), making gray cast iron easy to break.

In addition to compositions (e.g., carbon contents), many other factors also impact the structures and properties of cast irons, including the rate at which it cooled after casting and heat treatment after casting. Gray cast iron is usually cast in sand molds, and allowed to cool normally in the mold, and heat treatment may be optionally performed after casting.

Steels may be classified based on their carbon contents. Carbon steels may be divided into four classes: low-carbon steels, medium-carbon steels, high-carbon steels, and very-high-carbon steels. The low-carbon steels (or "mild" steels) are more widely used than other steels because they are ductile, easy to machine and easy to weld. In addition to these carbon steels, embodiments of the invention may also use stainless steels. Stainless steels contain chromium that can form a chromium oxide layer (a passivation layer) that can prevent rusting of the steels. Embodiments of the invention may use any steels that can be welded together, including carbon steels and stainless steels. In this description, the term "steel" is used to broadly refer to all kinds of steels, including carbon steels and stainless steels.

The above description highlights the different properties of steels and cast irons. In particular, their different ductibilities and melting temperatures make it difficult to weld steel together with cast iron. Therefore, when a dumbbell is made of a steel handle and cast iron weight plates, welding the cast iron weight plates to the steel handle may be difficult and the resulting weld may not have the strength and reliability necessary to withstand the abuse that a dumbbell is expected to be subjected to.

Embodiments of the invention relate to new dumbbells or barbells having unique weight plates design such that they can be confidently welded with steel handle bars. The weight plates in accordance with embodiments of the invention may be referred to as "hybrid" weight plates, which mainly comprise a heavy material (e.g., cast iron). However, such "hybrid' plates also comprise a center portion that is made of a second material and surrounds the hole for attaching the handle bar. The second material is selected for compatibility in welding with the materials used in handle bar. For example, when the handle bar is made of steel, the center portion of the weight plates may be also made of a steel material. The center portion may be referred to as a hub with a center hole (or simply a "hub") configured to accept a handle bar (i.e., a ring) in the following description. For example, when the center portion (hub) is made of a steel, it may be referred to as a steel hub. With such "hybrid" weight plates, the welding between a handle bar and a weight plate can be made between two steel parts (or two materials that are compatible for welding), instead of between steel and cast iron as in conventional dumbbells.

FIG. 2A shows a weight plate in accordance with one embodiment of the invention. As shown, a weight plate 20 comprises a peripheral portion 21 surrounding a center portion 22. The peripheral portion 21 may be made of a heavy material (e.g., cast iron), and the center portion 22 may be made of a material that is compatible for welding with a handle bar. The weight plate 20 in FIG. 2 is shown to have a round profile. However, other profiles are also suitable for weight plates, including oval, square, hexagonal, polygonal, and the like. In addition, the weight plate 20 is shown to have an optional circular outer ridge 29 along the outer periphery of the weight plate 20. The outer ridge 29 may be thicker (in the axial direction) than the plate part (e.g., the peripheral portion 21 and the center region 22) such that the joint between a weight plate and a handle bar is better protected (i.e., less likely to be hit). This feature is more clearly shown in the perspective views of FIGS. 4 and 6. However, such outer ridge 29 is optional and some embodiments of the invention may not include such a ridge.

The peripheral portion 21 and the center portion 22 may be joined using any suitable method known in the art. In preferred embodiments of the invention, the peripheral portion 21 is made of cast iron, while the center portion 22 is made of a steel. Therefore, the following examples may assume the material in the peripheral portion 21 is cast iron, and the material for the center portion 22 is steel. However, this combination of materials (cast iron and steel) is for illustration only. One skilled in the art would appreciate that other combinations of materials may also be used without departing from the scope of the invention.

As an example for manufacturing a hybrid weight plate, a steel hub (center portion) 22 may be placed in the mold while casting the cast iron peripheral portion 21. In this case, the outside surface of the steel hub 22 need not be smooth and may have protrusions or indentations to enhanced the attachment between the cast iron portion 21 and the steel hub 22. Alternatively, the cast iron peripheral portion 21 may be cast with a center hole adapted to fit the steel hub 22. In this case, the center hole in the cast iron peripheral portion 21 may be made to have a slightly smaller diameter than the outside diameter of the steel hub 22 such that a tight interference fit may be achieved. After manufacturing, the "hybrid" weight plate may be further subjected to high temperature treatments (e.g., firing) to improve the structural integrity.

Whether the steel hub 22 is placed during casting or after casting, the steel hub 22 need not have a round outside profile. Instead, it may have a profile of a square, oval, polygonal, etc. In addition, the steel hub 22 may have a shape, other than a short tube, to improve its secure attachment to the cast iron portion 21. For example, FIG. 2B shows a bobbin-shaped steel hub 22, having two side plates 22*a* and 22*b* defining a trough 22*c* therebetween. The cast iron portion 21 may be held in the trough 22*c* and between the two side plates 22*a* and 22*b*. One or both side plates 22*a* and 22*b* may be put in place and secured therein (e.g., welded on) after the cast iron portion 21 have been put in.

The above describes a few approaches that can be used to secure the steel hub 22 and the cast iron portion 21. These examples are for illustration only. One of ordinary skill in the art would appreciate that other variations and modifications are possible without departing from the scope of the invention.

As shown in FIG. 2A, the steel hub 22 has a hole 25 for inserting a handle bar (not shown in FIG. 2A). Therefore, the diameter of the hole 25 is configured to accommodate the outside diameter of a handle bar. In general, the diameter of the hole 25 may be configured to be the same as the outside diameter of the handle bar. In some embodiments, the diameter of the hole 25 may be configured to be slightly smaller than the outside diameter of a handle bar such that an interference fit may be accomplished. Again, the center hole need not be a circular shape, and other shapes may be used as long as they are complementary to the profiles of the handle bars.

In accordance with embodiments of the invention, a steel handle bar may be inserted into the center hole 25 in the steel hub 22 of a "hybrid" weight plate 20. Thereafter, welding can be performed between the steel handle bar and the steel hub 22. Such welding would avoid problems associated with welding of two different materials. More importantly, the resulting welds would have better strength and reliability because these welds are between steels (or between welding compatible materials).

FIG. 3 shows an example of a weight plate with a handle bar inserted therein. As shown, the weight plate 30 has a peripheral (cast iron) portion 31 surrounding a center portion (steel hub) 32. A handle bar 33 is inserted in the center hole in the steel hub 32. The fitting between the handle bar 33 and the steel hub 32 may be a tight interference fit. In addition, welding may be used to permanently secure the weight plate 30 to the handle bar 33. As shown in this example, three welding spots 39*a*, 39*b*, and 39*c* permanently connect the weight plate steel hub 32 to the handle bar 33. The number and locations of the welding shown are for illustration only. One of ordinary skill in the art would appreciate that any number of locations may be welded or the entire interface may be welded. Welding may be performed with any suitable method known in the art.

Figure 4:
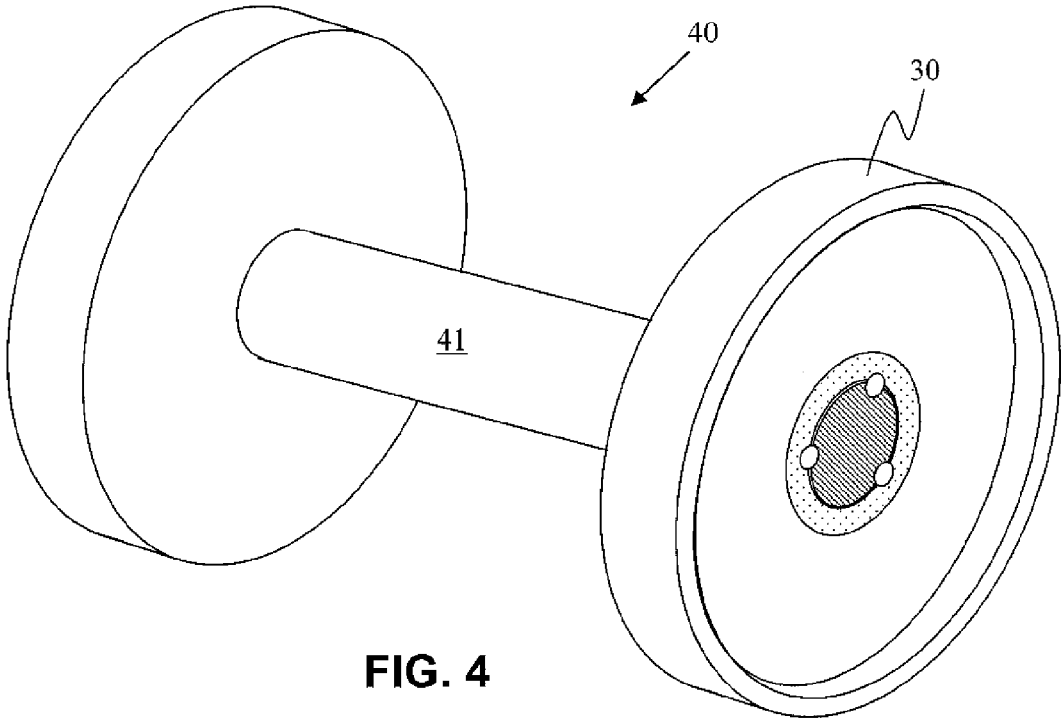
FIG. 4 shows a dumbbell in accordance with one embodiment of the invention.

In accordance with embodiments of the invention, welding of a handle bar to a weight plate is performed between two compatible materials (e.g., between steel and steel). Therefore, the resulting attachment is more reliable and is stronger. FIG. 4 shows an example of a dumbbell 40, which comprises a handle bar 41 with a weight plate 30 of FIG. 3 attached to each of the two ends.

In accordance with some embodiments of the invention, the handle bars may includes threads at the ends and nuts may be threaded to these ends of the handle bars to further secure the entire complex, thereby adding strength to the attachments. For example, FIG. 5 shows one such embodiment.

Figure 5:
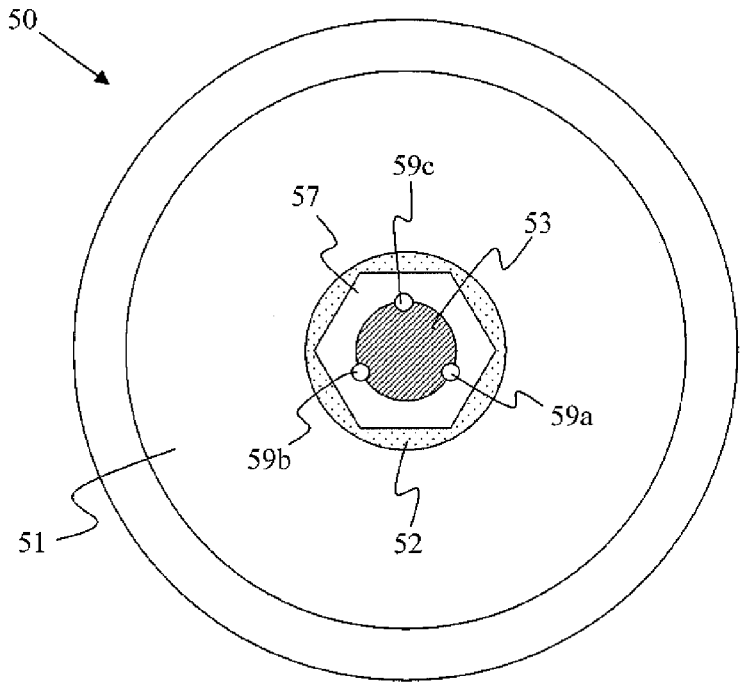
FIG. 5 shows a weight plate inserted on one end of a handle bar with a nut threaded thereon in accordance with one embodiment of the invention.

As shown in FIG. 5, a weight plate 50 comprises a peripheral (cast iron) portion 51 and a center portion (steel hub) 52 that are assembled in a manner similar to that shown in FIG. 3. In addition, a nut 57 is threaded on the end of the handle bar 53 to further secure the attachment. Furthermore, the nut 57 may be welded to the handle bar 52. With these embodiments, the nuts will provide added strength to the attachment.

Figure 6:
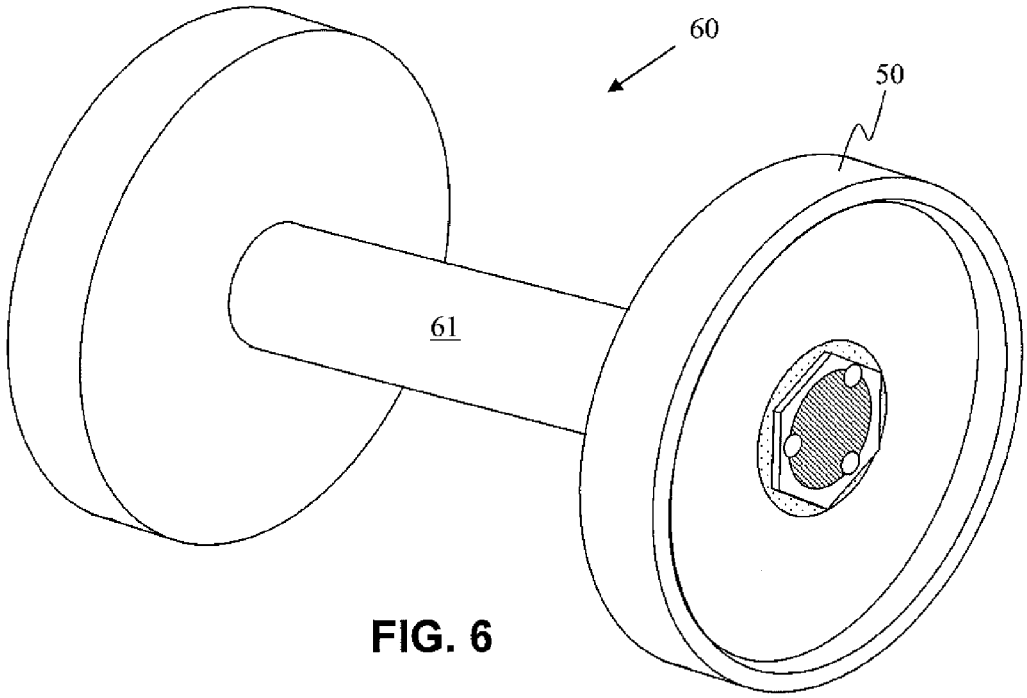
FIG. 6 shows a dumbbell in accordance with one embodiment of the invention.

FIG. 6 shows an example of a dumbbell 60 that comprises a handle bar 61 and a weight plate 51 of FIG. 5 attached to each of the both ends of the handle bar 61.

In the examples shown in FIGS. 3-6, the weight plates have outer ridges (shown as 29 in FIG. 2) that can protect the joints between the weight plates and the handle bars (see FIG. 4 and FIG. 6) from being accidentally hit. However, such ridges are not necessary, and some embodiments of the invention may not have such ridges. Whether the dumbbells include outer ridges on the weight plates or not, the end surfaces of the weight plates (and hence the joints between the handle bar and the weight plates) may be further protected with a cover, as illustrated in FIG. 7.

Figure 7:
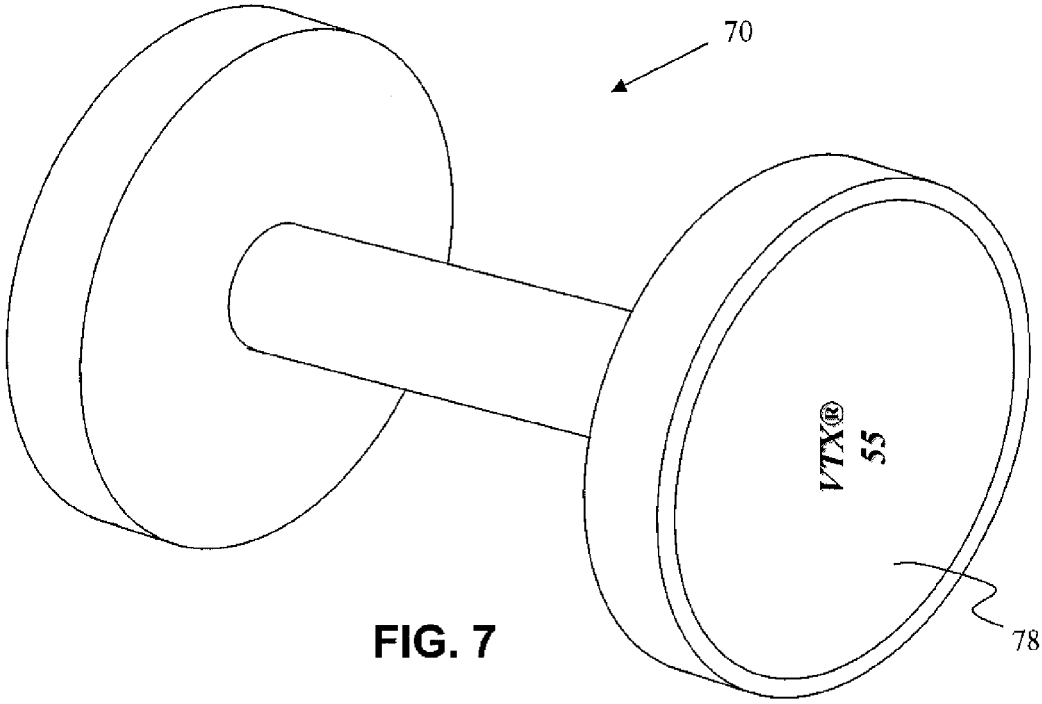
FIG. 7 shows another dumbbell in accordance with one embodiment of the invention.

As shown in FIG. 7, a dumbbell 70 having a cover plate 78 covering the end surface of a weight plate. In addition, the cover plate 78 may be used to provide information about the dumbbells, such as brands, trademarks, weights of the dumbbells, etc.

Figure 8:
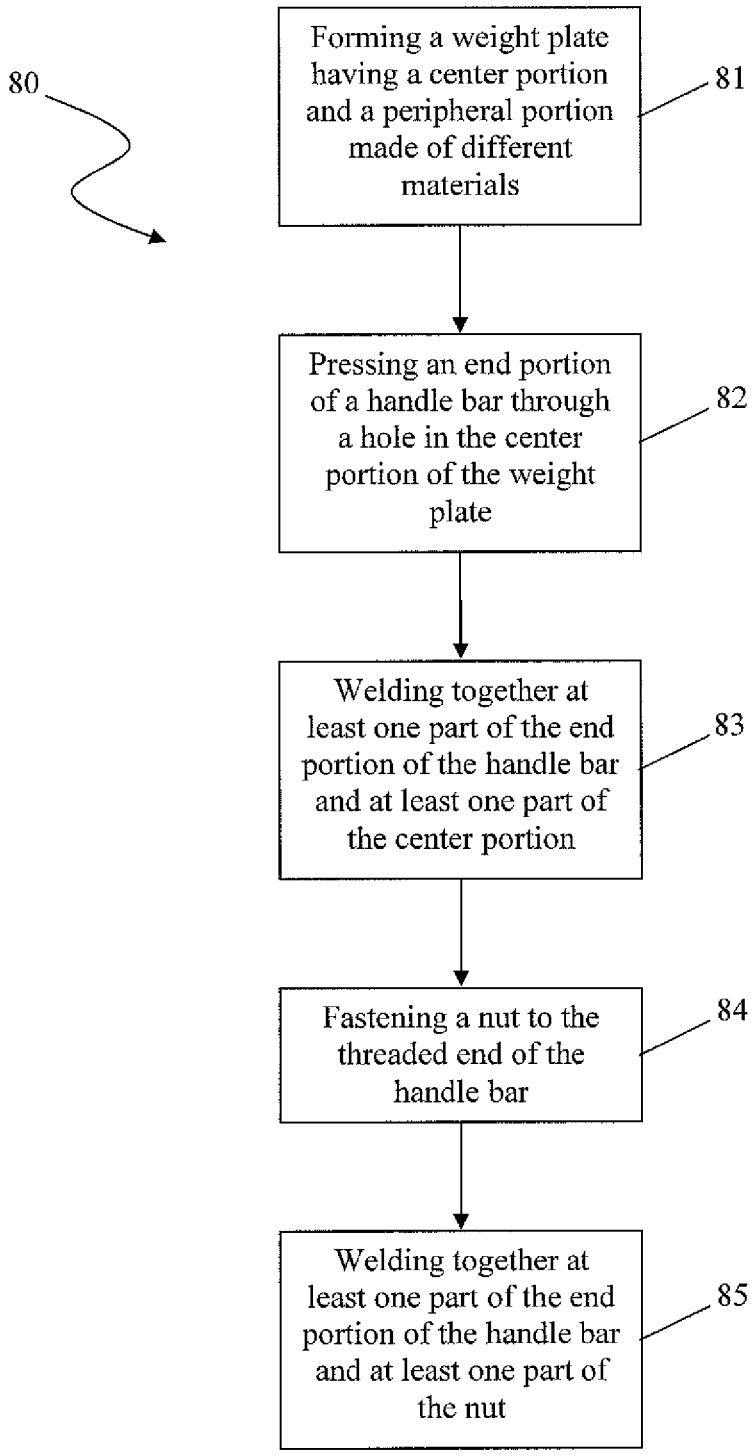
FIG. 8 shows a flow chart illustrating a method in accordance with one embodiment of the invention.

Some embodiments of the invention relate to methods for manufacturing dumbbells or barbells of the invention. FIG. 8 shows an exemplary method in accordance with one embodiment of the invention.

As shown in FIG. 8, a method 80 for making a dumbbell may include the step of forming a "hybrid" weight plate having a steel hub at or around the center of a cast iron weight plate (step 81). As noted above, such a "hybrid" weight plate may be manufactured by casting iron with a steel hub in place or by fitting a steel hub into a center hole in the cast iron weight plate. After assembling the "hybrid" weight plates, one may further heat the "hybrid" plates to a higher temperature to improve the structural integrity of the plates and the interface between the steel and the cast iron.

Next, the "hybrid' weight plates may be fitted on to a handle bar. This may be accomplished, for example, by pressing ends of the handle bar into the holes in the steel hubs on the weight plates (step 82).

To fixedly attach steel handle bar to the "hybrid" cast iron weight plates, the steel handle bar may be welded together with the steel hub of the hybrid weight plate (step 83). The welding may be performed at one or more locations at the interface between the handle bar and the steel hub, as illustrated in FIG. 3. Alternatively, the welding may be performed along the entire length (circumference) of the interface. Due to excellent weldability of steels, welds between the steel handle bar and the steel hub can produce stronger and more durable attachment to support cast iron head units. Welding may be performed using any methods known in the art.

In accordance with some embodiments of the invention, the weight plates may be further secured with steel nuts threaded on the end portions of handle bars. (step 84). To further secure the attachment of cast iron weight plates to the steel handle bar, one or more locations of the interface between the handle bar and the steel nuts may be welded together, as illustrated in FIG. 5 (step 85). The welding may also be performed along the entire length (circle) of the interface. Furthermore, when a nut is used and welded together with the handle bar, the welding between the steel handle bar and the steel hub, described in step 83, becomes optional.

Finally, the weight plates and/or the handle bar may be coated with a protective coating, which may be made of a durable material, such as a polymer or an elastomer. Polymers suitable for such coatings may include thermosetting polymers, such as vulcanized rubber and epoxies, and thermoplastic polymers, such as thermoplastic rubbers, including styrenic block copolymers, polyolefin blends, polyurethanes, thermoplastic copolyester, and thermoplastic polyamides. Any suitable coating methods known in the art may be used to coat the weight plates and/or handle bars of dumbbells of the invention.

Advantages of embodiments of the invention may include one or more of the following. Embodiments of the invention provide effective methods for securely welding two different materials together. These methods are particularly useful for making dumbbells or barbells. In accordance with embodiments of the invention, a non-steel weight plate may be provided with a steel hub such that the welding can be performed and the resulting weld would be strong and secure. With these methods, dumbbells or barbells can be make with cast iron weight plates and steel handle bars, thereby taking advantage of different material properties and economical benefits.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A weight lifting system, comprising:
a handle bar made of a first material; and
two weight plates,
wherein the handle bar is attached to the two weight plates by inserting each of two ends of the handle bar in a hole in each of the two weight plates,
wherein at least one of the two weight plates comprises a center portion made of a second material and a peripheral portion made of a third material, wherein the third material is different from both the first material and the second material,
wherein the center portion comprises the hole, in which one of the two ends of the handle bar is inserted, and the center portion is welded to the handle bar,
wherein a nut is threaded on the one of the two ends of the handle bar, and
wherein the nut is welded to the handle bar.

2. The weight lifting system of claim 1, wherein the third material is cast iron.

3. The weight lifting system of claim 1, wherein the first material and the second material are both steel.

4. The weight lifting system of claim 3, wherein the third material is cast iron.

5. The weight lifting system of claim 1, wherein the handle bar and/or the weight plate further comprises a coating.

6. A method for manufacturing a weight lifting system, comprising:
inserting an end of a handle bar made of a first material in a hole in a weight plate, wherein the weight plate comprises a center portion made of a second material and a peripheral portion made of a third material, the third material is different from both the first material and the second material, and wherein the hole in the weight plate is located in the center portion;
welding together the handle bar and the center portion of the weight plate;
threading a nut onto the end of the handle bar; and
welding together the nut and the handle bar.

7. The method of claim 6, wherein the third material is cast iron.

8. The method of claim 6, wherein the first material and the second material are both steel.

9. The method of claim 8, wherein the third material is cast iron.

10. The method of claim 6, further comprising encasing the handle bar and/or the weight plate in a protective coating.

* * * * *